US012378958B2

(12) United States Patent
Merkle

(10) Patent No.: US 12,378,958 B2
(45) Date of Patent: Aug. 5, 2025

(54) GEAR PUMP

(71) Applicant: VALEO EMBRAYAGES, Amiens (FR)

(72) Inventor: Manuel Merkle, Ebern (DE)

(73) Assignee: VALEO EMBRAYAGES, Amiens (FR)

( * ) Notice: Subject to any disclaimer, the term of this patent is extended or adjusted under 35 U.S.C. 154(b) by 0 days.

(21) Appl. No.: 18/595,525

(22) Filed: Mar. 5, 2024

(65) Prior Publication Data

US 2024/0301877 A1 Sep. 12, 2024

(30) Foreign Application Priority Data

Mar. 8, 2023 (DE) ..... 10 2023 105 779.0

(51) Int. Cl.

| | |
|---|---|
| ***F04C 2/18*** | (2006.01) |
| ***F04C 2/08*** | (2006.01) |
| ***F04C 2/16*** | (2006.01) |
| ***F04C 11/00*** | (2006.01) |
| ***F04C 15/00*** | (2006.01) |
| ***F16C 35/06*** | (2006.01) |

(52) U.S. Cl.

CPC ..... *F04C 2/084* (2013.01); *F04C 2/18* (2013.01); *F04C 11/001* (2013.01); *F04C 15/00* (2013.01); *F04C 2240/30* (2013.01); *F04C 2240/50* (2013.01)

(58) Field of Classification Search

CPC .. F04C 2/084; F04C 2/18; F04C 2/165; F04C 11/00; F04C 11/001; F04C 11/008; F04C 15/00; F04C 2240/50

See application file for complete search history.

(56) References Cited

U.S. PATENT DOCUMENTS 10,323,636 B2 * 6/2019 Craig ..... F16C 17/045

FOREIGN PATENT DOCUMENTS

| | | | | |
|---|---|---|---|---|
| CN | 104712554 A | * | 6/2015 | ..... F04C 2/18 |
| DE | 196 15 725 A1 | | 10/1997 | |
| DE | 10 2009 028 449 A1 | | 2/2011 | |
| DE | 10 2009 051 443 A1 | | 5/2011 | |
| DE | 10 2009 047 709 A1 | | 6/2011 | |
| DE | 102010038893 A1 | * | 2/2012 | ..... F02M 37/045 |
| DE | 10 2021 116 160 A1 | | 12/2022 | |
| EP | 0 831 232 B1 | | 3/2003 | |
| JP | 2018189018 A | * | 11/2018 | ..... F04C 2/18 |

OTHER PUBLICATIONS

English JP 2018/189018 by PE2E Jun. 27, 2024.*
English DE 102010038893 by PE2E Jun. 27, 2024.*
English translation of CN104712554 by PE2E Oct. 30, 2024.*
German Search Report issued Nov. 8, 2023 in German Application 10 2023 105 779.0 filed Mar. 8, 2023, 7 pages (with English Translation of Categories of Cited Documents & Written Opinion).

* cited by examiner

*Primary Examiner* — Deming Wan
(74) *Attorney, Agent, or Firm* — Oblon, McClelland, Maier & Neustadt, L.L.P.

(57) ABSTRACT

A gear pump, in particular for a hydraulic unit in a drive train of a motor vehicle, with a housing which consists of multiple housing parts, with a drive gear and with a pump gear, which are arranged inside the housing. The pump gear is mounted on a bearing structure designed integrally with one of the housing parts.

17 Claims, 4 Drawing Sheets

Fig. 6
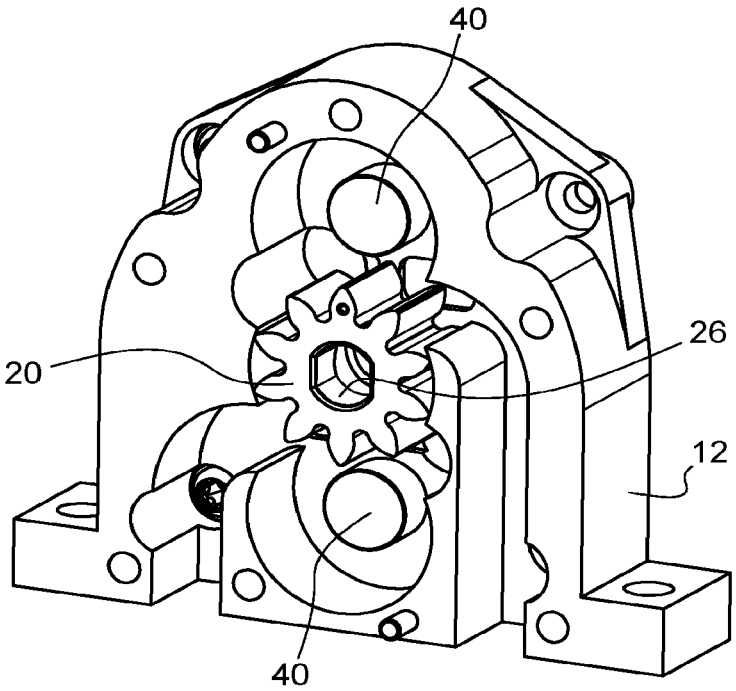
Fig. 7a
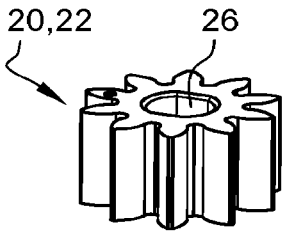
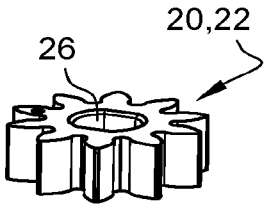
Fig. 8a
Fig. 7b
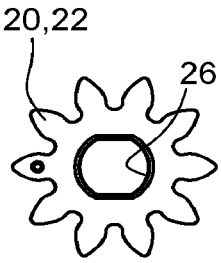
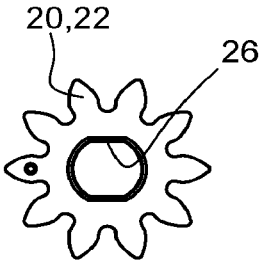
Fig. 8b
Fig. 7c
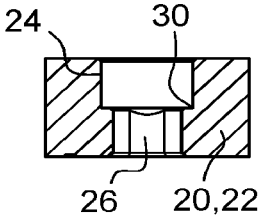
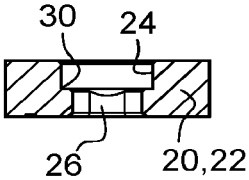
Fig. 8c

GEAR PUMP

BACKGROUND OF THE INVENTION

Field of the Invention

The invention relates to a gear pump, in particular for a hydraulic unit in a drive train of a motor vehicle, with a housing which consists of multiple housing parts, with a drive gear and with a pump gear, which are arranged inside the housing.

Description of the Related Art

The gear pump can be used to provide a volume flow of hydraulic fluid, for example in order to supply an actuator, a coolant circuit or a lubrication system.

An electric motor can be provided in order to drive the gear pump such that the gear pump can be operated flexibly with the desired output flow and can optionally also be completely switched off in phases in which no output flow is required.

In terms of the costs of the gear pump, it is desirable that the latter can be installed with little effort.

BRIEF SUMMARY OF THE INVENTION

The object of the invention is to provide a gear pump of the type mentioned at the beginning which can be installed with little effort.

In order to achieve this object, it is provided according to the invention in the case of a gear pump of the type mentioned at the beginning that the pump gear is mounted on a bearing structure formed integrally with one of the housing parts. The gear pump according to the invention is characterized by a very low number of components and accordingly by low production costs. The installation process is also greatly simplified because there is no need to install separate bearing components for the pump gear, for example a bearing axle.

The bearing structure is preferably a cylindrical protrusion such that a sliding bearing is available with a relatively large support surface.

According to an embodiment of the invention, it is provided that the pump is a single-stage pump and the pump gear is supported axially between a housing part and a housing cover. The pump gear is here mounted in an axial direction between the housing part and the housing cover without any additional measures being required.

According to an alternative embodiment, it is provided that the pump is a two-stage pump in which the pump gear of the first stage is arranged between a housing part and a housing intermediate part, and the pump gear of the second stage is supported axially between the housing intermediate part and a housing cover. In this embodiment, the housing part and the housing intermediate part can be provided with the bearing structure for the pump gear such that all the components can be installed in one direction one after the other.

According to an embodiment, it is provided here that the two stages differ in terms of their axial dimensions such that different flow volumes are obtained which are adapted to different applications.

It is preferably provided that two pump gears mesh in the drive gear such that a larger output flow results with small axial dimensions.

According to a preferred embodiment, it is provided that the drive gear and the pump gear are configured identically. This entails even more reduced production costs because only one type of gear has to be produced.

According to an embodiment of the invention, it is provided here that the drive gear and the pump gear have a cylindrical bearing portion and a torque-transmission portion which has a cross-sectional shape which differs from a circular shape. Depending on the application of the corresponding gear, one of these portions remains unused; in the case of the pump gear, the cylindrical bearing portion is used, whilst in the case of the drive gear, the torque-transmission portion is used. It has been shown that each of these portions, although it is configured as shorter in the axial direction than the corresponding gear, has a sufficient strength to be able to absorb the stresses which occur.

The torque-transmission portion can have in cross-section the shape of a slot with rounded end sides, as a result of which there is a low notch effect inside the gear. Moreover, the complementary torque-transmission region on a drive shaft can be produced relatively simply.

The bearing portion preferably has at least partially a larger radius than the torque-transmission portion such that a shoulder which is active in the axial direction is formed between the bearing portion and the torque-transmission portion, which shoulder can be used for axial positioning.

According to an embodiment of the invention, a drive shaft is provided which is connected non-rotatably to the drive gear, wherein the drive shaft is fixed in the axial direction in interaction with the drive gear. In this embodiment, there is a saving in an axial bearing for the bearing shaft because the bearing shaft is fixed in the axial direction by means of the drive gear in the pump housing.

In order to axially fasten the drive gear on the drive shaft, it can be provided that the drive gear is pressed onto the drive shaft.

It can also be provided that the drive shaft has a bearing collar which is arranged between a housing part and the drive gear. This bearing collar, which can for example be a retaining ring which is accommodated in a groove of the drive shaft, is then supported in one direction directly on one of the housing parts and in the other direction indirectly, namely via the drive gear, on another of the housing parts. The drive shaft is also reliably fixed in the axial direction as a result.

According to an embodiment, it is provided that the drive shaft has a torque-transmission region which is arranged between two bearing regions, wherein a first one of the bearing regions has a larger external diameter than the torque-transmission region, and the second bearing region has a smaller external diameter than the torque-transmission region. The graduated external diameters enable the gear pump to be installed in a single direction, which facilitates the installation process.

According to an embodiment of the invention, it is provided that a rotor of a drive motor is arranged axially fixedly and non-rotatably on the drive shaft, wherein the first bearing region is arranged between the rotor and the torque-transmission region. This makes it possible for the drive shaft to be ready installed in the housing together with the pump gear and the drive gear, such that a pre-installed pump module is created, on the drive shaft of which the rotor is already installed. This module can then be installed on a housing of an electric motor such that the gear pump is completed.

BRIEF DESCRIPTION OF THE SEVERAL VIEWS OF THE DRAWINGS

The invention will be described below by means of an embodiment which is illustrated in the appended drawings, in which:

FIG. 6 shows the housing part of the first pump stage in a perspective view, wherein only the drive gear is shown therein;

FIGS. 7*a*, 7*b* and 7*c* show the gear used in the first pump stage in a perspective view, a plan view and a view in section; and FIGS. 8*a*, 8*b* and 8*c* show the gear used in the second pump stage in a perspective view, a plan view and a view in section.

DETAILED DESCRIPTION OF THE INVENTION

Figure 1:
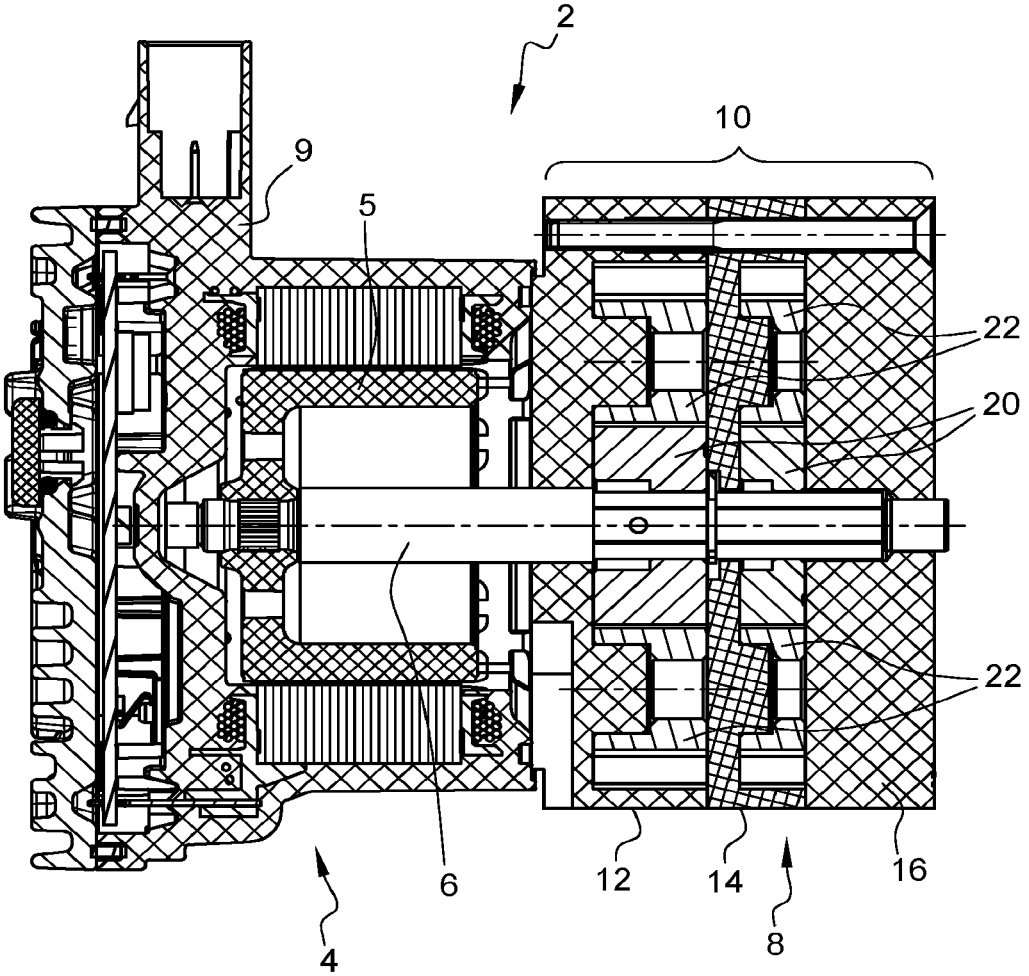
FIG. 1 shows a cross-section through a gear pump according to the invention.

A gear pump 2 which is provided to provide a hydraulic oil output flow is shown in FIGS. 1 to 7. This can be used, in particular in the drive train of a motor vehicle, to supply an actuator, for example to supply a clutch actuator or a gear selector, or lubrication points, for example in a gearbox or a clutch, or also in order to provide a flow of cooling oil in order, for example, to cool the friction linings of a friction clutch.

The gear pump 2 has a drive motor 3 which is configured here as an electric motor with a rotor 5.

The rotor 5 is installed axially fixedly and non-rotatably on a drive shaft 6 which is mounted in the pump module 8 of the gear pump 2.

The pump module 8 has a housing 10 which in turn has a housing part 12, a housing intermediate part 14 and a housing cover 16.

The pump module 8 forms, together with the drive shaft 6 and the rotor 5, a pre-installed assembly which can be installed on a housing 9 of the electric motor 4 in which the stator of the electric motor is also provided.

The gear pump is here configured as a two-stage pump, wherein a first stage is formed between the housing part 12 and the housing intermediate part 14, and a second stage is formed between the housing intermediate part 14 and the housing cover 16. The term "stage" applies to the stages of gears which are present.

Each stage has a drive gear 20 as well as two pump gears 22. The pump is configured as a double-suction one for each stage.

The drive gear 20 and the two pump gears 22 of each stage are configured identically; they therefore differ only in terms of their function. The drive gear 20 is driven by the electric motor and the pump gears 22 mesh in the drive gear 20.

Each of the gears has a cylindrical bearing portion 24 and a torque-transmission portion 26. These are arranged next to each other in the axial direction (see in particular FIGS. 7*c* and 8*c*). Each of the portions extends here over approximately 50% of the axial length of the gear 20, 22.

The bearing portion 24 is configured as a cylindrical protrusion. The torque-transmission portion 26 has, in contrast, a cross-sectional shape which differs from a circular shape. In the exemplary embodiment shown, the torque-transmission portion 26 has in cross-section the shape of a slot with rounded end sides (see in particular FIGS. 7*b* and 8*b*).

The bearing section 24 has a larger cross-section than the torque-transmission portion 26 such that, viewed from the side of the bearing portion 24, an axial abutment shoulder 30 is formed (see in particular FIGS. 7*c* and 8*c*).

The drive shaft 6 has a torque-transmission region 32 which is configured with a cross-sectional shape adapted to the torque-transmission portion 26. The drive gears 20 are arranged on the torque-transmission region 32 (see in particular FIG. 2). The torque-transmission portion 26 is coupled to the torque-transmission region 32 such that the drive gears 20 are co-rotated when the drive shaft 6 is set in rotation. The bearing portion 24 of the drive gears 20 here has no function.

The drive shaft 6 is fixed in the axial direction inside the housing 10. For this purpose, a bearing collar in the form of a retaining ring 34 is provided which engages in a groove in the drive shaft 6. The retaining ring 34 (see in particular FIG. 2) here lies in a depression in the housing intermediate part 14 on the side facing the first stage of the gear pump. Axial stresses on the drive shaft 6 are thus absorbed in one direction directly in the housing intermediate part 14 and in the other direction via the drive gear 20 of the first pump stage of the housing part 12.

The drive shaft 6 is mounted in the housing 10 by means of two bearing regions 36, 38, wherein the bearing region 36 is configured on the side of the rotor 5 with a large external diameter and the bearing region 38 is configured on the side of the housing cover 16 with a small diameter. The torque-transmission region 32, the diameter of which is smaller than the diameter of the bearing region 36 but larger than the diameter of the bearing region 38, lies between them.

The pump gears 22 are mounted in the housing 10 by means of the bearing portion 24 which is received on a bearing structure 40. The bearing structure 40 is in each case designed integrally with one of the housing parts and designed so that it complements the bearing portion 24 in the corresponding pump gear 22.

For the first pump stage, the bearing structure 40 is configured as a cylindrical protrusion which is configured integrally with the housing part 12.

For the second pump stage, the bearing structure 40 is configured as a cylindrical protrusion which is configured integrally with the housing intermediate part 14.

Figure 2:
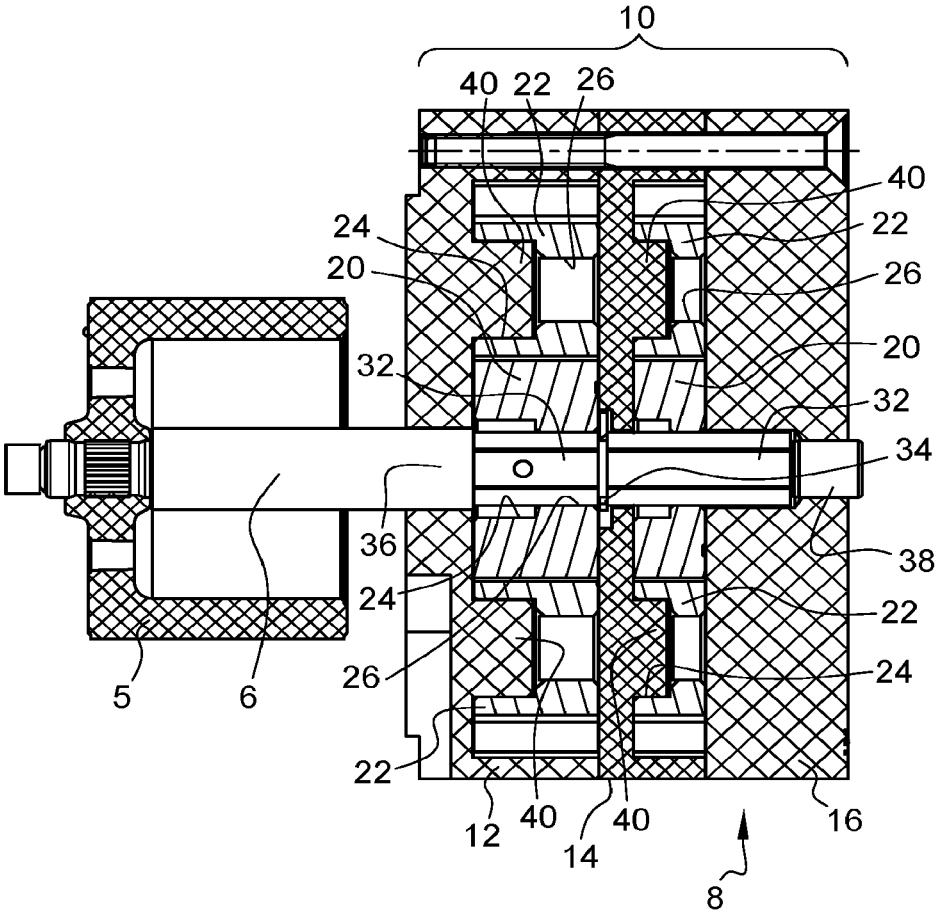
FIG. 2 shows a cross-section through the pre-installed pump module.
Figure 3:
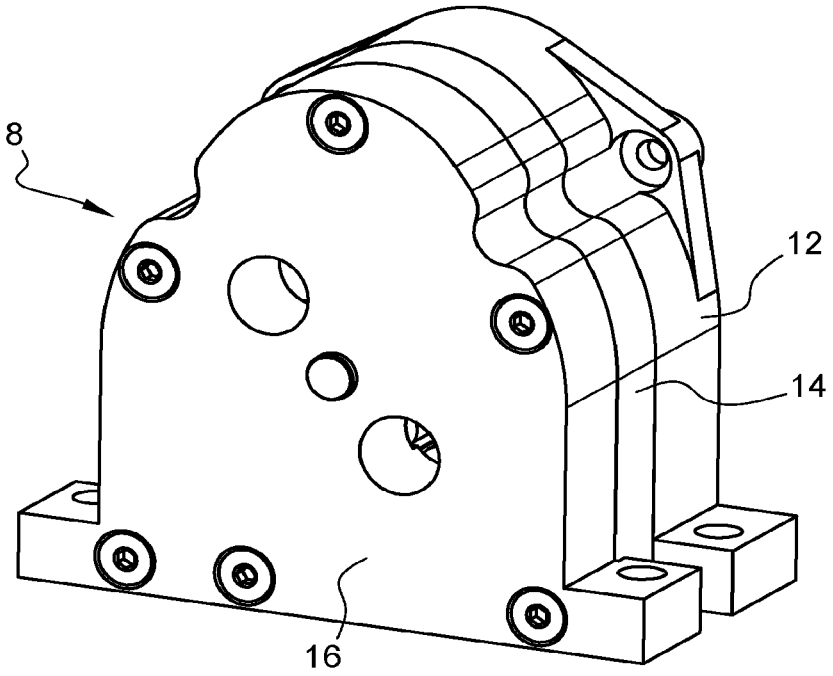
FIG. 3 shows the housing of the gear pump in a perspective view of the side facing away from the drive motor.
Figure 4:
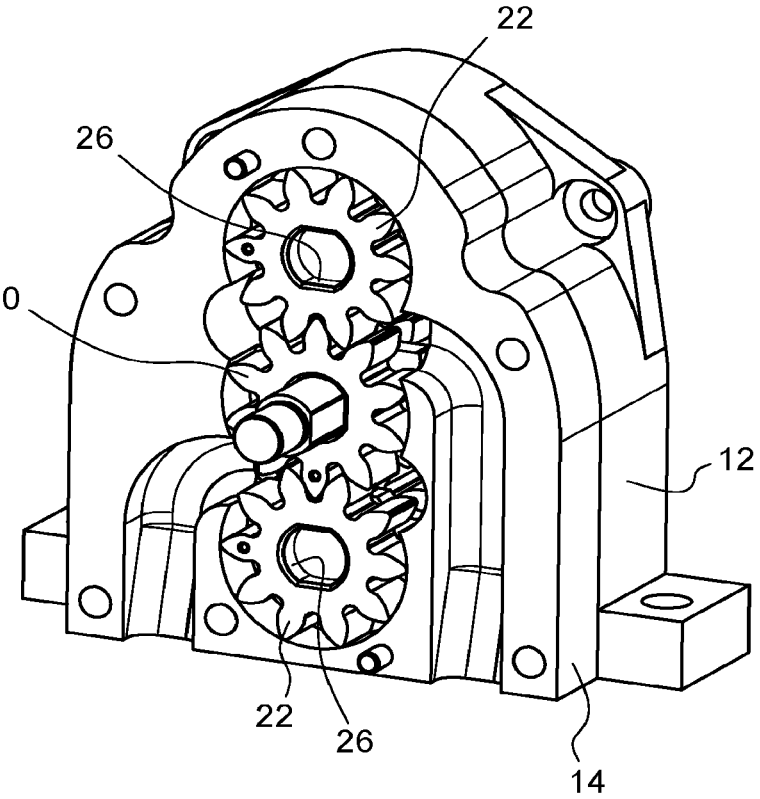
FIG. 4 shows the housing in a perspective view according to that in FIG. 3, wherein the housing cover is removed.
Figure 5:
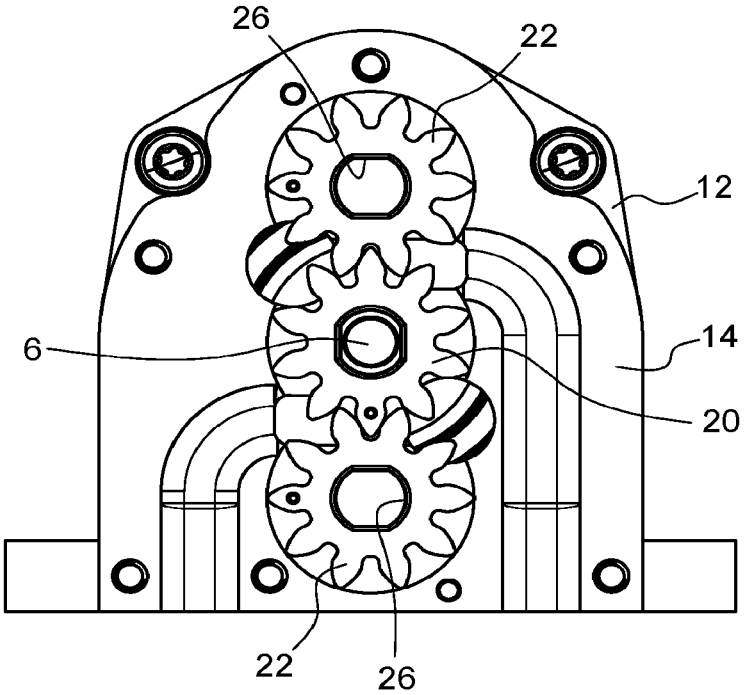
FIG. 5 shows a side view of the gear pump with the housing cover removed.

As can be seen in particular in FIG. 2, the pump gears 22 sit with their bearing portion 24 on the bearing structure 40, whilst the torque-transmission portion 26 here has no function.

Because of the structure of the different components of the gear pump, the latter can be installed particularly simply.

In a first step, the rotor 5 is fastened on the drive shaft 6. For example, the rotor 5 can be moulded directly onto the drive shaft 6.

The housing part 12 is then pushed onto the drive shaft 6 and the pump gears 22 can be placed into the housing part 12 onto the bearing structures 40. The drive gear 20 is also installed on the drive shaft 6. In the next step, the retaining ring 34 is attached and the housing intermediate part 14 is installed. The drive gear 20 and the pump gears 22 of the second pump stage are in turn installed therein. The housing is then closed by means of the housing cover 16.

It can be seen that the installation takes place in one direction, for example from left to right with reference to FIG. 2.

The invention claimed is:

1. A gear pump for a hydraulic unit in a drive train of a motor vehicle, comprising:

a housing including multiple housing parts; and a drive gear and a pump gear which are arranged inside the housing, wherein bearing structures are designed integrally with at least two of the multiple housing parts, the pump gear being mounted on at least one of the bearing structures, wherein the drive gear and the pump gear are configured identically, and wherein the drive gear and the pump gear have a cylindrical bearing portion and a torque-transmission portion which has a cross-sectional shape which differs from a circular shape.

2. The gear pump according to claim 1, wherein the bearing structures are cylindrical protrusions.

3. The gear pump according to claim 2, wherein the pump is a single-stage pump and the pump gear is supported axially between a housing part and a housing cover.

4. The gear pump according to claim 2, wherein the pump is a two-stage pump in which the pump gear of the first stage is arranged between a housing part and a housing intermediate part, and the pump gear of the second stage is supported axially between the housing intermediate part and a housing cover.

5. The gear pump according to claim 2, comprising two pump gears, wherein two pump gears mesh in the drive gear.

6. The gear pump according to claim 1, wherein the pump is a single-stage pump and the pump gear is supported axially between a housing part and a housing cover.

7. The gear pump according to claim 1, wherein the pump is a two-stage pump including a first stage and a second stage, in which the pump gear of the first stage is arranged between a housing part and a housing intermediate part, and the pump gear of the second stage is supported axially between the housing intermediate part and a housing cover.

8. The gear pump according to claim 7, wherein axial dimensions of the two stages are different.

9. The gear pump according to claim 1, comprising two pump gears, wherein the two pump gears mesh in the drive gear.

10. The gear pump according to claim 1, wherein the torque-transmission portion has in cross-section the shape of a slot with rounded end sides.

11. The gear pump according to claim 10, wherein the bearing portion has at least partially a larger radius than the torque-transmission portion.

12. The gear pump according to claim 1, wherein the bearing portion has at least partially a larger radius than the torque-transmission portion.

13. The gear pump according to claim 1, wherein a drive shaft is provided which is connected non-rotatably to the drive gear, wherein the drive shaft is fixed in an axial direction in interaction with the drive gear.

14. The gear pump according to claim 13, wherein the drive shaft has a bearing collar which is arranged between a housing part and the drive gear.

15. The gear pump according to claim 14, wherein the bearing collar is a retaining ring which is accommodated in a groove of the drive shaft.

16. The gear pump according to claim 13, wherein the drive shaft has a torque-transmission region which is arranged between two bearing regions, wherein a first one of the bearing regions has a larger external diameter than the torque-transmission region, and the second bearing region has a smaller diameter than the torque-transmission region.

17. The gear pump according to claim 13, wherein a rotor of a drive motor is attached axially fixedly and non-rotatably on the drive shaft, wherein the first bearing region is arranged between the rotor and the torque-transmission region.

* * * * *